US006401280B1

(12) United States Patent
Baker

(10) Patent No.: US 6,401,280 B1
(45) Date of Patent: Jun. 11, 2002

(54) PORTABLE BED RAILING

(76) Inventor: Amy C. Baker, 4011 Del Bello Rd., Manvel, TX (US) 77578

( * ) Notice: Subject to any disclaimer, the term of this patent is extended or adjusted under 35 U.S.C. 154(b) by 0 days.

(21) Appl. No.: 09/747,843

(22) Filed: Dec. 26, 2000

(51) Int. Cl.[7] ..... A61G 7/053; A47C 21/08
(52) U.S. Cl. ..... 5/662; 5/426; 5/429; 5/430
(58) Field of Search ..... 5/662, 429, 426, 5/430, 504.1, 505.1, 506.1

(56) References Cited

U.S. PATENT DOCUMENTS

| | | | | | |
|---|---|---|---|---|---|
| 1,066,976 | A | * | 7/1913 | Atkinson | 5/426 |
| D208,607 | S | | 9/1967 | Williams | |
| 3,474,473 | A | * | 10/1969 | Hannaberg | 5/426 |
| 3,553,746 | A | | 1/1971 | Seiger | |
| 3,739,793 | A | | 6/1973 | Wilson | |
| 4,686,727 | A | | 8/1987 | Wilkinson | |
| 4,969,221 | A | | 11/1990 | Foster | |
| 5,305,773 | A | | 4/1994 | Browning | |
| 5,463,784 | A | * | 11/1995 | Alpern | 5/430 |
| 5,671,490 | A | * | 9/1997 | Wu | 5/426 |
| 5,781,945 | A | * | 7/1998 | Scherer et al. | 5/426 |
| 6,068,225 | A | * | 5/2000 | O'Brien et al. | 5/662 |
| 6,138,301 | A | * | 10/2000 | Battiston | 5/662 |
| 6,289,539 | B1 | * | 9/2001 | Alpern | 5/662 |

* cited by examiner

*Primary Examiner*—Alexander Grosz

(57) ABSTRACT

A portable bed railing for retrofitting bed railing to existing beds. The portable bed railing includes a first portion for defining a substantially vertical railing. The first portion includes a rod having a first end and a second end. Each of a pair of elongate members is integrally coupled to and extends away from one of the first and second ends of the rod. The elongate members extend in a generally parallel direction to each other and each is orientated generally perpendicular to the rod. A second portion for positioning between a mattress and box spring includes a bar having a first end and a second end. Each of a pair of pole members is integrally coupled to and extends away from one of the first and second ends of the bar. The pole members extend in a generally parallel direction to each other and each is orientated generally perpendicular to the bar. Each of the pole members has a free end hingedly coupled to one of the elongate members.

7 Claims, 5 Drawing Sheets

PORTABLE BED RAILING

BACKGROUND OF THE INVENTION

1. Field of the Invention

The present invention relates to bed railing and more particularly pertains to a new portable bed railing for retrofitting bed railing to existing beds.

2. Description of the Prior Art

The use of bed railing is known in the prior art. More specifically, bed railing heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,553,746; U.S. Pat. No. 3,739,793; U.S. Pat. No. 5,305,773; U.S. Pat. No. 4,686,727; U.S. Pat. No. 4,969,221; and U.S. Des. Pat. No. 208,607.

While these devices fulfill their respective, particular objectives and requirements, the aforementioned patents do not disclose a new portable bed railing. The inventive device includes a first portion for defining a substantially vertical railing. The first portion includes a rod having a first end and a second end. Each of a pair of elongate members is integrally coupled to and extends away from one of the first and second ends of the rod. The elongate members extend in a generally parallel direction to each other and each is orientated generally perpendicular to the rod. A second portion for positioning between a mattress and box spring includes a bar having a first end and a second end. Each of a pair of pole members is integrally coupled to and extends away from one of the first and second ends of the bar. The pole members extend in a generally parallel direction to each other and each is orientated generally perpendicular to the bar. Each of the pole members has a free end hingedly coupled to one of the elongate members.

In these respects, the portable bed railing according to the present invention substantially departs from the conventional concepts and designs of the prior art, and in so doing provides an apparatus primarily developed for the purpose of retrofitting bed railing to existing beds.

SUMMARY OF THE INVENTION

In view of the foregoing disadvantages inherent in the known types of bed railing now present in the prior art, the present invention provides a new portable bed railing construction wherein the same can be utilized for retrofitting bed railing to existing beds.

The general purpose of the present invention, which will be described subsequently in greater detail, is to provide a new portable bed railing apparatus and method which has many of the advantages of the bed railing mentioned heretofore and many novel features that result in a new portable bed railing which is not anticipated, rendered obvious, suggested, or even implied by any of the prior art bed railing, either alone or in any combination thereof.

To attain this, the present invention generally comprises a first portion for defining a substantially vertical railing. The first portion includes a rod having a first end and a second end. Each of a pair of elongate members is integrally coupled to and extends away from one of the first and second ends of the rod. The elongate members extend in a generally parallel direction to each other and each is orientated generally perpendicular to the rod. A second portion for positioning between a mattress and box spring includes a bar having a first end and a second end. Each of a pair of pole members is integrally coupled to and extends away from one of the first and second ends of the bar. The pole members extend in a generally parallel direction to each other and each is orientated generally perpendicular to the bar. Each of the pole members has a free end hingedly coupled to one of the elongate members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable bed railing apparatus and method which has many of the advantages of the bed railing mentioned heretofore and many novel features that result in a new portable bed railing which is not anticipated, rendered obvious, suggested, or even implied by any of the prior art bed railing, either alone or in any combination thereof.

It is another object of the present invention to provide a new portable bed railing which may be easily and efficiently manufactured and marketed.

It is a further object of the present invention to provide a new portable bed railing which is of a durable and reliable construction.

An even further object of the present invention is to provide a new portable bed railing which is susceptible of a low cost of manufacture with regard to both materials and labor, and which accordingly is then susceptible of low prices of sale to the consuming public, thereby making such portable bed railing economically available to the buying public.

Still yet another object of the present invention is to provide a new portable bed railing which provides in the apparatuses and methods of the prior art some of the advantages thereof, while simultaneously overcoming some of the disadvantages normally associated therewith.

Still another object of the present invention is to provide a new portable bed railing for retrofitting bed railing to existing beds.

Yet another object of the present invention is to provide a new portable bed railing which includes a first portion for defining a substantially vertical railing. The first portion includes a rod having a first end and a second end. Each of a pair of elongate members is integrally coupled to and extends away from one of the first and second ends of the rod. The elongate members extend in a generally parallel direction to each other and each is orientated generally perpendicular to the rod. A second portion for positioning between a mattress and box spring includes a bar having a first end and a second end. Each of a pair of pole members is integrally coupled to and extends away from one of the first and second ends of the bar. The pole members extend in a generally parallel direction to each other and each is orientated generally perpendicular to the bar. Each of the pole members has a free end hingedly coupled to one of the elongate members.

Still yet another object of the present invention is to provide a new portable bed railing that has height adjustable elongate members to accommodate different bed heights.

Even still another object of the present invention is to provide a new portable bed railing that is easily fitted and retrofittable to existing beds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
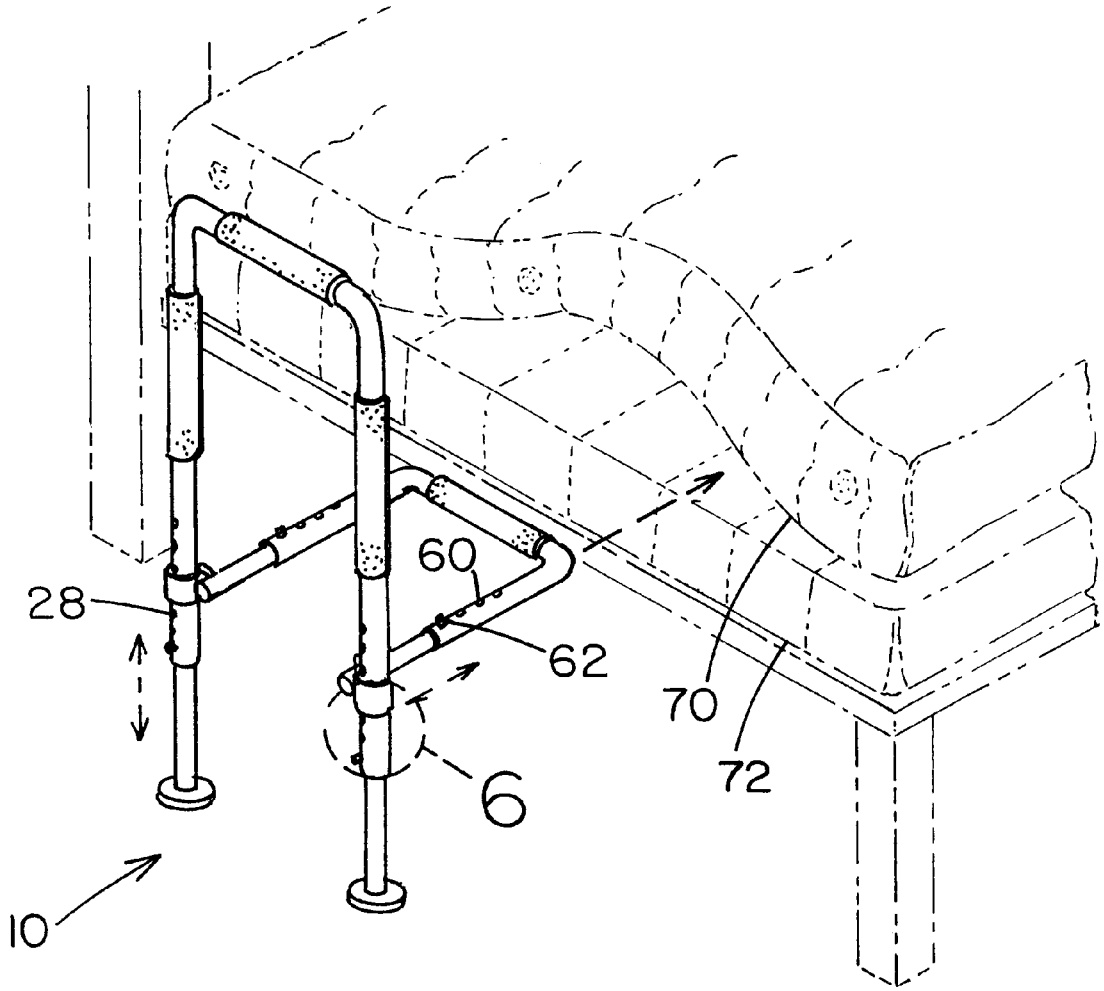
FIG. 1 is a schematic perspective view of a new portable bed railing according to the present invention.

With reference now to the drawings, and in particular to FIGS. 1 through 6 thereof, a new portable bed railing embodying the principles and concepts of the present invention and generally designated by the reference numeral 10 will be described.

As best illustrated in FIGS. 1 through 6, the portable bed railing 10 includes a first portion 12 for defining a substantially vertical railing. The first portion 12 includes a rod 14 having a first end 16 and a second end 18. Each of a pair of elongate members 20 is integrally coupled to and extends away from one of the first 16 and second 18 ends of the rod 14. The elongate members 20 extend in a generally parallel direction to each other and are each orientated generally perpendicular to the rod 14. Each of the elongate members 20 has a free end 22. Each of a pair of plates 24 has a top surface securely coupled to one of the free ends 22 of the elongate members 20 and each of the plates 24 defines a foot. Each of the elongate members 20 is telescoping and has a first section 25 movably extendable into a second section 26. Each of the first sections 25 has a hole 28 therein. The second sections 26 each have a plurality of aligned opening 30 therein. Each of a pair of nubs 32 is biased outwardly from one of the holes 28 in the first section for releasably engaging one of the openings to selectively couple first and second sections together.

A second portion 40 is positionable between a mattress 70 and a box spring 72. The second portion 40 includes a bar 42 having a first end 44 and a second end 46. Each of a pair of pole members 48 is integrally coupled to and extends away from one of the first 44 and second 46 ends of the bar 42. The pole members 48 extend in a generally parallel direction to each other and each is orientated generally perpendicular to the bar 42. Each of the pole members 48 has a free end 50 hingedly coupled to one of the elongate members 20. Preferably, a nub 52 is extendable through the first 12 and second 40 portions to selectively lock them in a perpendicular relationship with each other. Each of the pole members 48 is telescoping and has a first member 54 movably extendable into a second member 56. Each of the first members 54 has a hole therein generally identical to the hole 28 in the first section 25. Each of the second members 56 has a plurality of aligned openings 60 therein. Each of a pair of nubs 62 is biased outwardly from one of the holes in the first member for releasably engaging one of the openings in the second member to selectively couple the first members to the second members.

Each of a plurality of pads 64 has a generally cylindrical shape. A first 65 of the pads extends around the rod 14. A second 66 of the pads extends around the first of the elongate members 20 and is positioned generally adjacent to the rod 14. A third 67 of the pads extends around the second of the elongate members 20 and is positioned generally adjacent to the rod 14. A fourth 68 of the pads extends around the bar 42. Each of the pads comprises an elastomeric material that is ideally a foamed elastomeric material.

Figure 3:
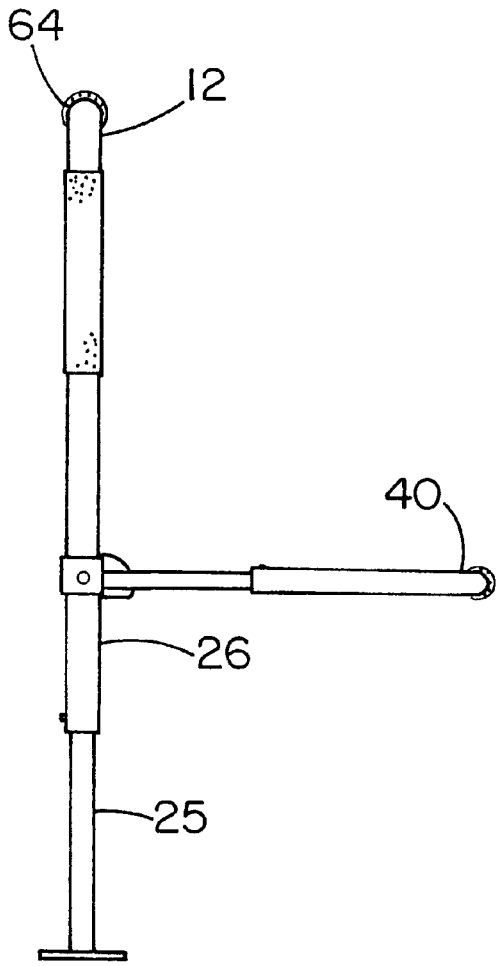
FIG. 3 is a schematic side view of the present invention.
Figure 2:
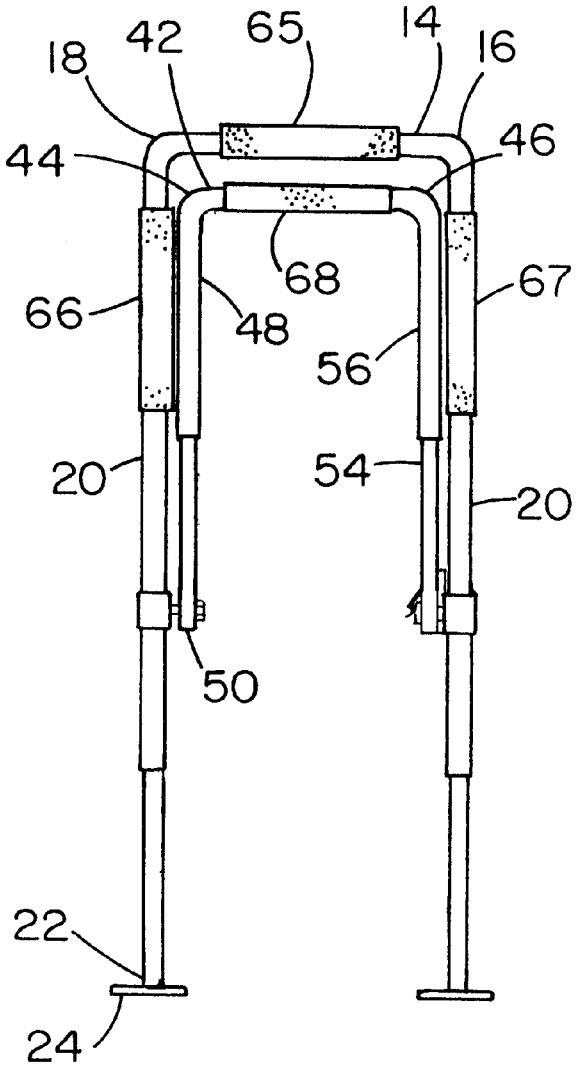
FIG. 2 is a schematic front view of the present invention.
Figure 4:
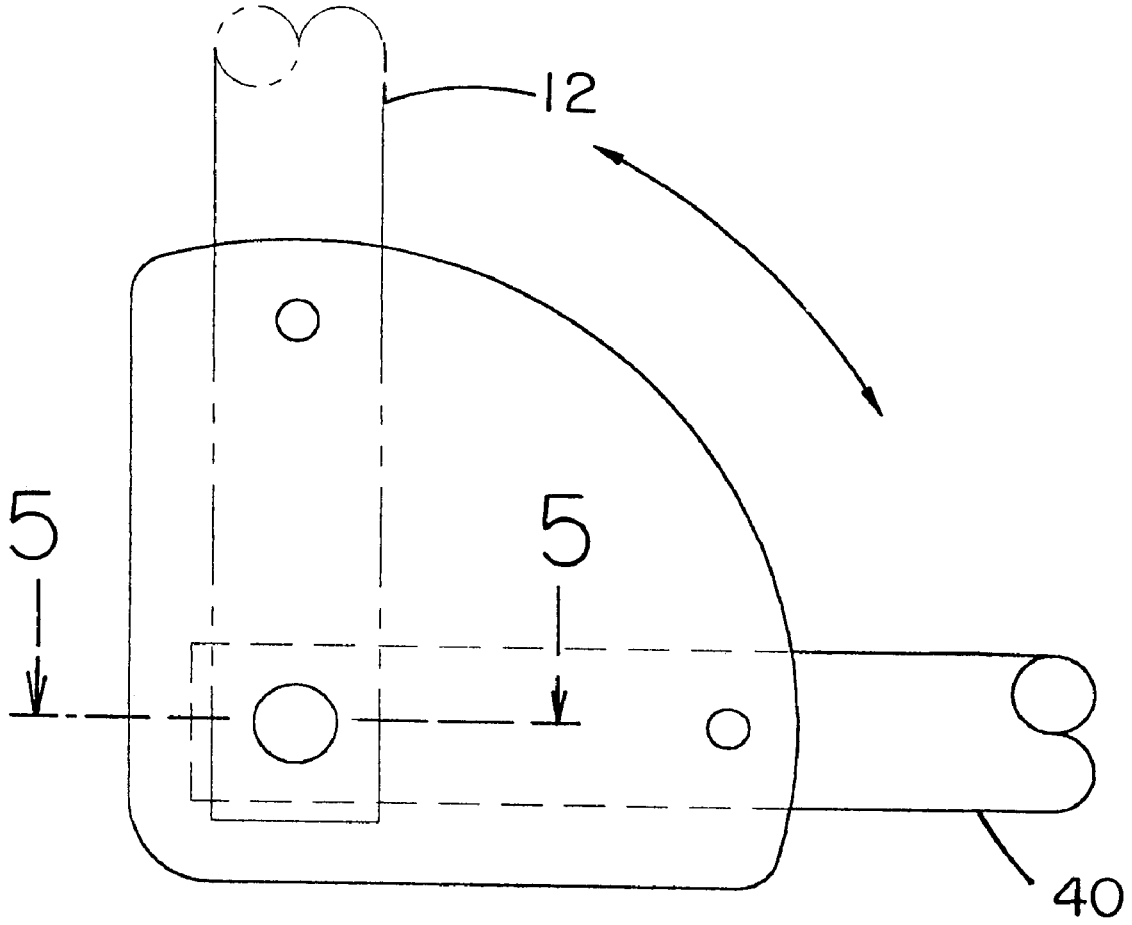
FIG. 4 is a schematic exploded side view of a hinge of the present invention.
Figure 5:
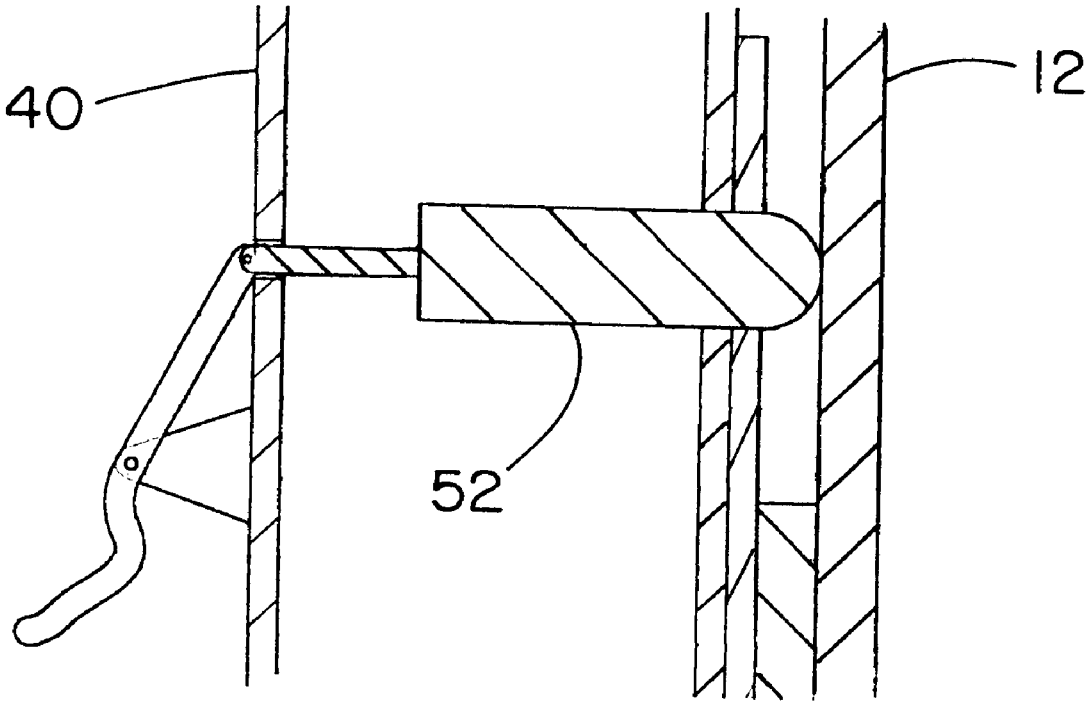
FIG. 5 is a schematic cross-sectional view of the nub of the present invention.
Figure 6:
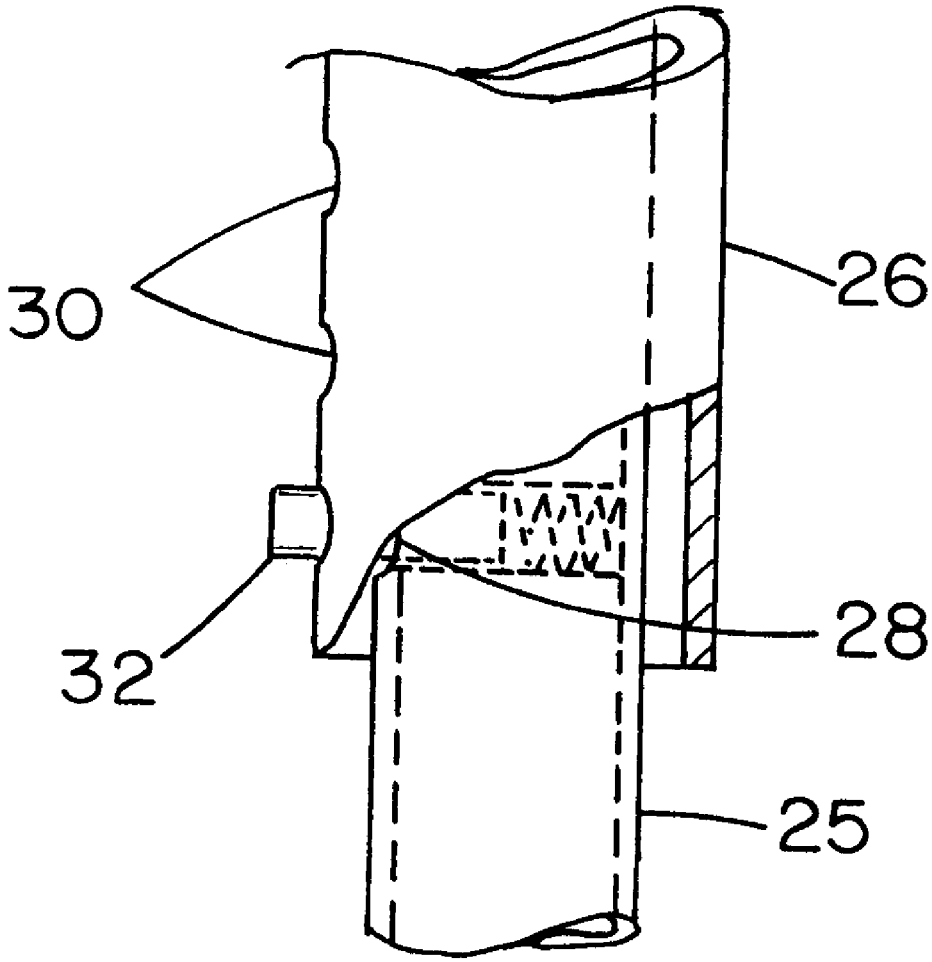
FIG. 6 is a schematic exploded view of area 6 of the present invention.

In use, the height of first portion 12 is adjusted to a selected height so that the second portion 40 may be placed between the mattress 70 and box spring 72 when the two portions are in a generally perpendicular relationship to each other as shown in FIG. 3. The second portion 40 is then placed under the mattress so that the weight of the mattress 70 holds the first portion 12 in a vertical orientation. The first portion 12 may then act as a railing for a person needing such assistance.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable bed rail device, said device being removably positionable between a mattress and a box spring of a bed, said device comprising:

a first portion for defining a substantially vertical railing, said first portion including a rod having a first end and a second end, each of a pair of elongate members being integrally coupled to and extending away from one of said first and second ends of said rod, said elongate members extending in a generally parallel direction to each other and each being orientated generally perpendicular to said rod, each of said elongate members having a free end;

a second portion for positioning between the mattress and box spring, said second portion including a bar having a first end and a second end, each of a pair of pole members being integrally coupled to and extending away from one of said first and second ends of said bar, said pole members extending in a generally parallel direction to each other and each being orientated generally perpendicular to said bar, each of said pole members having a free end hingedly coupled to one of said elongate members; and a pair of plates, each of said plates having a top surface being securely coupled to one of said free ends of said elongate members such that each of said plates defines a foot.

2. The portable bed rail device as in claim 1, wherein each of said elongate members is telescoping and has a first section movably extendable into a second section, each of said first sections having a hole therein, each of said second sections having a plurality of aligned openings therein, each of a pair of nubs being biased outwardly from one of said holes in said first section for releasably engaging one of said openings to selectively couple said first and second sections together.

3. The portable bed rail device as in claim 2, wherein each of said pole members is telescoping and has a first member movably extendable into a second member, each of said first members having a hole therein, each of said second members having a plurality of aligned openings therein, each of a pair of nubs being biased outwardly from one of said holes in said first members for releasably engaging one of said openings to selectively couple said first and second members together.

4. The portable bed rail device as in claims 1, wherein each of said pole members is telescoping and has a first member movably extendable into a second member, each of said first members having a hole therein, each of said second members having a plurality of aligned openings therein, each of a pair of nubs being biased outwardly from one of said holes in said first members for releasably engaging one of said openings to selectively couple said first and second members together.

5. The portable bed rail device as in claim 1, further including a plurality of pads, each of said pads having a generally cylindrical shape, a first of said pads extending around said rod, a second of said pads extending around the first of said elongate members and positioned generally adjacent to said rod, a third of said pads extending around the second of said elongate members and positioned generally adjacent to said rod, a fourth of said pads extending around said bar, each of said pads comprising an elastomeric material.

6. The portable bed rail device as in claim 1, further including a pad, said pad having a generally cylindrical shape, said pad extending around said rod.

7. A portable bed rail device, said device being removably positionable between a mattress and a box spring of a bed, said device comprising:

a first portion for defining a substantially vertical railing, said first portion including a rod having a first end and a second end, each of a pair of elongate members being integrally coupled to and extending away from one of said first and second ends of said rod, said elongate members extending in a generally parallel direction to each other and each being orientated generally perpendicular to said rod, each of said elongate members having a free end, each of a pair of plates having a top surface being securely coupled to one of said free ends of said elongate members and each of said plates defining a foot, each of said elongate members being telescoping and having a first section movably extendable into a second section, each of said first sections having a plurality of aligned holes therein, each of said second sections having one opening therein, each of a pair of pins being removably positionable in one of said openings in said second sections and extendable into one of said holes to selectively couple said first and second sections together;

a second portion for positioning between the mattress and box spring, said second portion including a bar having a first end and a second end, each of a pair of pole members being integrally coupled to and extending away from one of said first and second ends of said bar, said pole members extending in a generally parallel direction to each other and each being orientated generally perpendicular to said bar, each of said pole members having a free end hingedly coupled to one of said elongate members, each of said pole members being telescoping and having a first member, movably extendable into a second member, each of said first sections having a hole therein, each of said second sections having a plurality of aligned openings therein, each of a pair of nubs being biased outwardly from one of said holes in said first section for releasably engaging one of said. openings to selectively couple said first and second sections together; and a plurality of pads, each of said pads having a generally cylindrical shape, a first of said pads extending around said rod, a second of said pads extending around the first of said elongate members and positioned generally adjacent to said rod, a third of said pads extending around the second of said elongate members and positioned generally adjacent to said rod, a fourth of said pads extending around said bar, each of said pads comprising an elastomeric material.

* * * * *